US010271588B2

(12) United States Patent
Steinberg

(10) Patent No.: US 10,271,588 B2
(45) Date of Patent: Apr. 30, 2019

(54) FLEECE SHORTS WITH DURABLE WIND-BLOCKING POCKET

(71) Applicant: Dan Steinberg, Blacksburg, VA (US)

(72) Inventor: Dan Steinberg, Blacksburg, VA (US)

( * ) Notice: Subject to any disclaimer, the term of this patent is extended or adjusted under 35 U.S.C. 154(b) by 1 day.

(21) Appl. No.: 15/805,048

(22) Filed: Nov. 6, 2017

(65) Prior Publication Data

US 2018/0064179 A1 Mar. 8, 2018

Related U.S. Application Data

(63) Continuation-in-part of application No. 14/453,623, filed on Aug. 7, 2014, now abandoned.

(51) Int. Cl.

| | |
|---|---|
| ***A41D 1/08*** | (2018.01) |
| ***A41D 27/20*** | (2006.01) |
| ***A41D 27/28*** | (2006.01) |
| ***A41D 1/06*** | (2006.01) |

(52) U.S. Cl.

CPC ..... *A41D 1/08* (2013.01); *A41D 1/06* (2013.01); *A41D 27/20* (2013.01); *A41D 27/28* (2013.01); *A41D 2400/10* (2013.01); *A41D 2400/20* (2013.01)

(58) Field of Classification Search

CPC ..... A41D 1/08; A41D 1/06; A41D 13/02
See application file for complete search history.

(56) References Cited

U.S. PATENT DOCUMENTS

| | | | | |
|---|---|---|---|---|
| 5,282,277 A * | 2/1994 | Onozawa | ..... | A41D 13/00 2/108 |
| 7,891,018 B2 * | 2/2011 | Atkinson | ..... | A41B 13/00 2/24 |
| 8,486,035 B1 * | 7/2013 | Arce | ..... | A61F 5/449 2/227 |
| 2014/0026294 A1 * | 1/2014 | Holland | ..... | A41D 10/00 2/228 |

* cited by examiner

*Primary Examiner* — Tajash D Patel

(57) ABSTRACT

A shorts garment comprising insulating fleece and durable, wind-blocking patch pockets. The shorts comprise fleece front and rear panels with high air permeability. The patch pockets comprise durable, non-stretch fabric with low air permeability. The low air permeability of the patch pockets provides wind and cold protection for the thigh areas. The air permeabilities of the pocket fabric and fleece fabric are within disclosed numerical ranges. Additionally, the pocket permeability is optionally less than ½, ¼ or 1/10 the permeability of the fleece panels. The patch pockets protect the fleece from wear and abrasion. A crotch area between the pockets has high air permeability fleece, and so the crotch receives cooling air ventilation. The patch pockets preferably cover about 20%, 30%, 40% or more of the front fleece panels. The present shorts garment is comfortably warm in cool temperatures and over a wide temperature range.

25 Claims, 6 Drawing Sheets

FLEECE SHORTS WITH DURABLE WIND-BLOCKING POCKET

RELATED APPLICATIONS

The present application claims the benefit of copending patent application Ser. No. 14/453,623, filed on Aug. 7, 2014.

FIELD OF THE INVENTION

The present invention relates generally to clothing garments. More specifically, it relates to fleece shorts designed for use in cold and cool temperatures.

BACKGROUND OF THE INVENTION

Many people enjoy wearing short pants (shorts) in cool weather, such as in temperatures of about 35-70 F. Some people even wear shorts in freezing temperatures. However, there are few shorts products available for these people. Insulated shorts are essentially unknown.

Polyester fleece (e.g. POLARFLEECE™) is a warm, lightweight fabric that has been used extensively for warm outdoor clothing. Fleece is typically made of polyester or polyester terephthalate. One or both surfaces of fleece has soft pile, comprising freestanding cut or looped yarns or fibers.

Fleece is an excellent fabric for use in outdoor clothing, because it is warm, soft, lightweight and retains warmth in wet conditions.

There are several reasons why fleece is generally not suitable for use in outdoor shorts, however. First, fleece is typically easily stretched, torn and worn, and so is not durable enough for outdoor pants or shorts. Also, fleece is highly air permeable so wind flows through it easily. The result is that fleece shorts can be uncomfortably hot when the wind is still, and uncomfortably cold in windy conditions. Adding additional layers or windproofing can make the shorts too hot, especially in the crotch area. Also, additional layers will increase cost and detract from the desirable soft texture of fleece.

Also, fleece is stretchy and floppy, so it feels too insubstantial for people that prefer to wear shorts made of more rigid and durable fabric like denim, canvas, twill or the like.

For these reasons, fleece shorts are undesirable to many people.

Consequently, there is a need for fleece shorts that overcomes these problems.

SUMMARY

The present invention provides a shorts garment comprising two tubes joined at one end, for receiving a human waist and legs. The tubes are made of fleece fabric and have front panels on one side. A waistband circumscribes the joined end. A patch pocket is attached to an exterior surface of each front panel. Each patch pocket comprises a non-stretch, non-fleece fabric. The fleece front panels and the patch pocket fabric have air permeabilities of at least 50 CFM/SF and at most 30 CFM/SF, respectively. Also, each patch pocket covers at least about 20% of each respective front panel.

The patch pockets can have an air permeability less than 35, 20, 15 or 10 CFM/SF, as measured by ASTM D737. The fleece fabric can have an air permeability of at least 40, 50, 60, 70 CFM/SF, or in the range of 50-350 CFM/SF, 60-350 CFM/SF or 70-350 CFM/SF, as measured by ASTM D737.

The air permeability of the patch pockets can be less than ½, ¼, or 1/10 of the air permeability of the fleece.

The patch pockets can cover at least 25%, 30%, 35% or 40% of each respective front panel.

The patch pockets can be attached to the waistband along a top edge. The patch pockets can have openings along a top edge or along a side edge.

A crotch area between the patch pockets can have an air permeability of at least 50 CFM/SF over at least 40% of the crotch area.

The patch pockets can cover up to 80% of the front panels.

The present shorts garment can also comprise rear patch pockets attached to rear panels made of fleece. The rear patch pockets can have an air permeability less than ½, ¼, or 1/10 the air permeability of the fleece fabric, and can cover at least about 10% of the rear panels.

DETAILED DESCRIPTION

The present invention provides a shorts garment for cool and cold temperatures (e.g. in the range of 35-70 F). The present shorts garment is made of fleece and has durable, wind-blocking patch pockets. The fleece has a relatively high air permeability, and the patch pockets have a relatively low air permeability. The patch pockets cover the thigh areas of the shorts, and preferably cover a large portion of the thigh areas. The patch pockets are spaced apart such that a fleece crotch area (located between the patch pockets) is not covered by the patch pockets. Consequently, the crotch area is ventilated by air flow through the fleece, thereby keeping the crotch area relatively cool. The thigh areas are better insulated due to the wind-blocking property of the patch pockets. This pocket placement provides a comfortable balance between warmth, and cooling air ventilation. Also, the present shorts garment is durable enough for outdoor use due to the durability and large size of the patch pockets.

Definitions

Fleece: a fabric with pile of at least 1 mm on at least one side. Fleece is commonly made of polyethylene terephthalate, polyester, cotton, or cotton-poly blend. Fleece fabrics are typically knitted.

Pile: the raised surface or nap of a fabric, which is made of upright fiber loops or cut fibers. For the fleece fabrics contemplated herein, the pile height of the fleece will generally be about 1-6 mm on one or both sides.

Air Permeability: A measurement of resistance to air flow. A standard test method of air permeability of fabrics is ASTM D737, which indicates air permeability in units of cubic feet of air per minute, per square foot (CFM/SF), at a pressure differential of 0.5 inches water. All air permeability measurements given herein are based on ASTM D737 and are in units of CFM/SF at 0.5 inches water pressure.

Non-stretch: Non-stretch fabric has less than 15% elongation when subjected to tensile stress of about 10 pounds applied to a strip 1 inch wide. Alternatively can experience less than 10% or 5% elongation.

Figure 1:
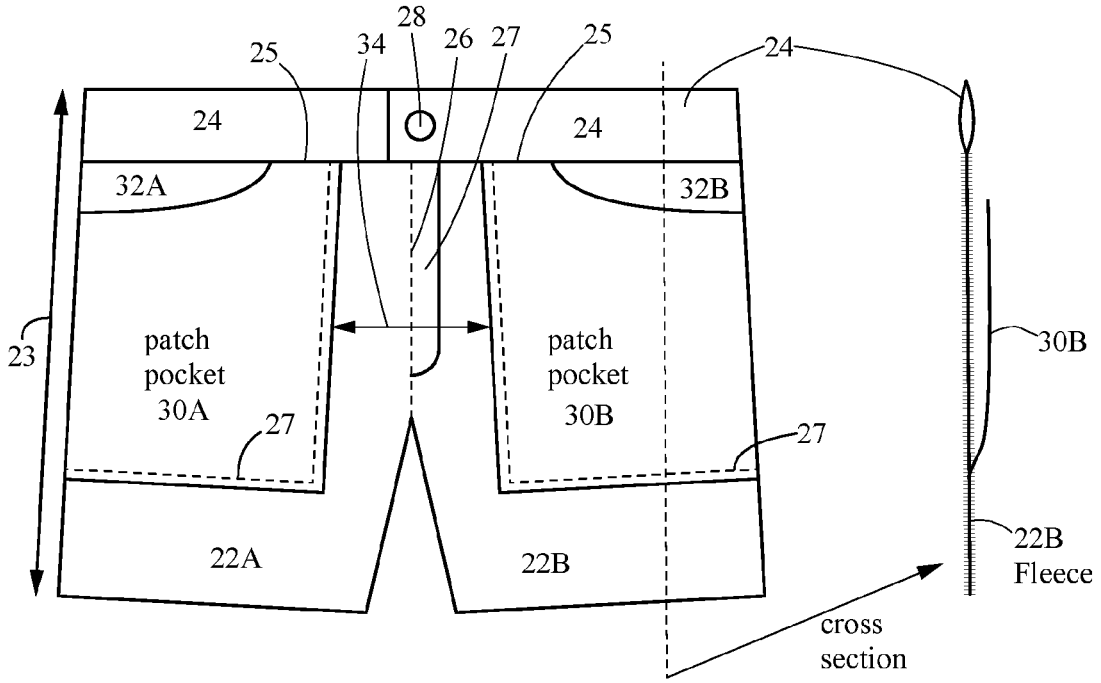
FIG. 1 shows a front view, and cross sectional view of a shorts garment according to the present invention.

FIG. 1 shows a front view of a shorts garment according to one embodiment of the present invention. The shorts comprise a right front panel 22A and a left front panel 22B, both of which are made of a fleece fabric. The shorts have a waistband 24, a fly closure 26 (e.g. zipper or button fly as known in the art), and a button or snap closure 28. Front patch pockets 30A 30B are attached (e.g. by sewn seams 27) to the front panels 22A 22B. The front panels 22A 22B are (optionally) exposed in pocket opening areas 32A 32B above the patch pockets 30A 30B. In other words, the areas 32A 32B may optionally comprise exposed fleece fabric.

A total length 23 of the shorts can be about 10-30 inches or 15-25 inches for example. Shorts typically have lengths less than about 18, 20, 22, 24 or 28 inches for example.

The waistband 24 can comprise a non-stretch fabric, such as a woven polyester or nylon (e.g. twill or nylon taffeta). The waistband can be made of the same fabric as the patch pockets, for example. The waistband may further comprise belt loops and optionally a built-in belt (not shown), as known in the art. Also, the waistband can comprise elastic, as known in the art.

A crotch area 34 is defined as the space between the patch pockets 30A 30B. The crotch area can be about 2-14 inches wide or 4-8 inches wide, for example. However, the appended claims are not limited to any particular values for the width of the crotch area 34.

The patch pockets 30A 30B are optionally attached to the waistband 24 at a top edge 25. The pocket-waistband attachment avoids tensile stress on the front panel fleece fabric, which has a tendency to rip, stretch or wear poorly when under tensile load, especially if the tensile load is concentrated in a small area. Some fleece fabric cannot support the weight of the patch pocket when loaded or weight of a wearers hands. Fleece fabrics tend to be fragile and easily torn.

The patch pockets can be sewn directly on top of the fleece front panels, so the pocket (interior) has one side comprising the patch pocket fabric, and one side comprising fleece.

The patch pockets 30A 30B provide several functions besides mere pocket utility. The patch pockets 30A 30B block air flow through the fleece front panels 22A 22B. This is helpful for providing warmth for the wearer because fleece alone is highly air permeable and loses much of its insulating ability in windy conditions. The patch pockets are located over the thigh area of the wearer. This is an ideal location for blocking wind, because the thigh areas are generally the most exposed to wind.

Also, the patch pockets 30A 30B improve the durability of the shorts. The patch pockets 30A 30B are made of durable, non-stretch, abrasion-resistant fabric, and so protect the fleece in the thigh area, where intense wear occurs.

A critical aspect of the present invention is the air permeability of the fleece fabric comprising the front panels 22A 22B, and the air permeability of the fabric comprising the patch pockets 30A 30B.

The fleece fabric comprising the front panels will have an air permeability of at least 50, 60 or 70 CFM/SF, or in the range of 50-350 CFM/SF. Typical polyester fleece fabrics contemplated in the present invention have air permeabilities of 85, 135, 170 and 305 CFM/SF. The high air permeability of the fleece allows some fresh air to ventilate the crotch area 34, thereby preventing uncomfortable overheating in the crotch.

The fleece fabric can be about 2-12 mm or 3-10 mm thick, for example, with about 1-6 mm tall pile on one or both sides. In one specific embodiment, the fleece fabric has a total thickness of about 8-9 mm, with about 4 mm pile on each side, and an air permeability of about 80-90 CFM/SF. In another specific embodiment suitable for slightly warmer temperatures, the fleece fabric has a total thickness of about 5-6 mm, with about 3 mm pile on one side and 2 mm pile on the other, and an air permeability of about 130-140 CFM/SF. Also, the fleece fabric can have a weight of about 100-600 grams/square meter, or about 200-400 grams/square meter.

Fleece fabrics typically have some stretch capability in at least one direction (due to the fact that fleece fabrics typically are knitted). The fleece fabrics contemplated for use in the present shorts may have no stretch, or may have stretch in one or both directions. The present invention is not limited to having any particular amount of stretch in the fleece fabric. However, some stretch may be desirable because it allows the wearer greater freedom of movement.

In contrast, the patch pockets 30A 30B comprise a non-stretch fabric with lower air permeability than the fleece. Typical patch pocket fabrics contemplated in the present invention have air permeabilities of 24, 12, 7, and 2.5 CMF/SF. Fabrics with air permeabilities less than 20, 10 or 5 CFM/SF are generally preferred for the pockets. The low air permeability of the patch pockets, combined with the insulating nature of the front panel fleece fabric, provides exceptionally effective thermal insulation in the areas of the patch pockets (i.e. in the areas covering the thighs). Low air permeability, non-stretch fabrics suitable for the patch pockets include wovens such as denim, canvas, twill, taffeta, poplin and woven sueded fabrics. Sueded woven polyester fabrics such as PASSIONSUEDE™ are particularly desirable because they are extremely durable, have low stretch and have very low air permeability (often less than 5 CFM/SF).

Non-stretch fabrics contemplated for use in the patch pockets will typically have less than 15% or 10% elongation when subjected to ensile loading of 10 pounds per 1-inch width. Sueded woven polyester fabric for example will elongate less than about 3-5% when tensile loaded at about 10 pounds per 1 inch fabric width.

The patch pocket fabric may have a weight of about 4-10 ounces per square yard, for example.

It is noted that the patch pocket fabric can be coated (e.g. with urethane) to reduce air permeability. Also, the patch pocket may comprise multiple layers of fabric to achieve suitably low air permeability. Also, the patch pocket may be lined with a fleece (e.g. with single-sided pile) or other soft insulating fabric to improve comfort and warmth of the pocket.

Also, it is noted that the patch pocket fabric is more durable and wear-resistant than the fleece fabric comprising the front panels. Since the thigh areas are commonly exposed to abrasion and wear, the patch pockets greatly enhance the durability of the shorts.

The crotch area 34 will typically comprise a portion of the fleece front panels 22A 22B. At least a portion of the crotch area 34 optionally comprises a single layer of the fleece fabric, and therefore has a high air permeability. Preferably, at least a portion (e.g. 40%) of 10 the crotch area has an air permeability greater than 50, 60 or 70 CFM/SF. Additional fabric layers may be present in the crotch area as part of the fly 26 (e.g. a zipper fly typically has a fabric backing), or fly cover flap 27. Such additional fabric layer(s) may reduce somewhat the air permeability in the fly portion of the crotch area 34. For example, about 20-80% of the crotch area can comprise a single fleece layer, but the present invention and appended claim 15 are not limited to this range. However, the crotch area 34, on average, may have a higher air permeability than the patch pockets 30A 30B.

Due to the high permeability of the fleece, the crotch area 34 does not become uncomfortably hot. Also, due to the low permeability of the patch pockets, the thigh areas (the areas most exposed to wind) are protected against wind. Consequently, the crotch is insulated due to the fleece fabric, but is less insulated than the thigh areas covered by the patch pockets. The present shorts garment therefore provides the unique and surprising benefit of comfortable warmth over a wide temperature range. The present shorts garment is warm in cold or cool weather (e.g. in the range of 35-65 F), especially in the thigh areas, but does not cause crotch overheating in moderate or room temperatures (e.g. in the range of 65-75 F).

Figure 2A:
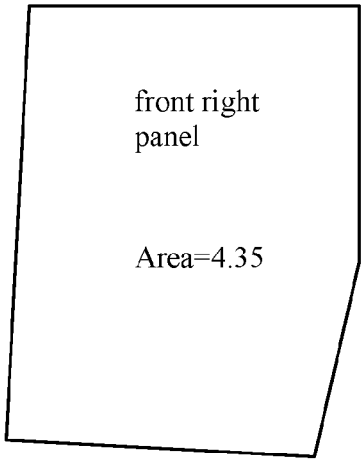
FIGS. 2A and 2B illustrate how to calculate surface area coverage of the front panels by the front patch pockets.
Figure 2B:
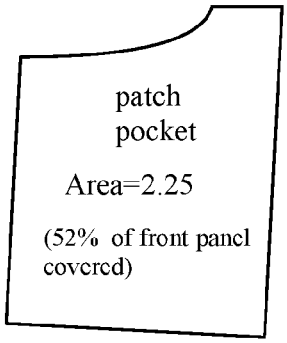

An important consideration in the present invention is the size of the front patch pockets 30A 30B relative to the size of the front panels 22A 22B. Specifically, according to the present invention the front patch pockets 30A 30B should cover enough of the front panels 22A 22B to provide substantial wind, wear and abrasion protection for the thigh areas. Preferably, the front patch pockets 30A 30B cover at least about 20%, 25%, 30%, or 35% of the respective front panels 22A 22B. FIGS. 2A and 2B illustrate how this area coverage is calculated for the embodiment of FIG. 1. In this specific illustration, the front panel has a surface area of 4.35 arbitrary units, and the patch pocket has a surface area of 2.25 arbitrary units. Accordingly, the surface area of the front panel covered by the patch pocket in the embodiment of FIG. 1 is about 2.25/4.35=52%.

The high surface coverage of the front patch pockets 30A 30B assures that the present shorts garment provides an adequate level of wind, wear and abrasion protection for the thigh areas. In shorts designed for use in relatively colder temperatures, the coverage can be relatively high, for example in the range of 50-70%. Shorts intended for use in warmer temperatures may have lower coverage of about 20-40%.

It is noted that the coverage is typically not more than 75%, 80% or 90%, however, as it is desirable to have some air ventilation in the crotch area 34.

Figure 3A:
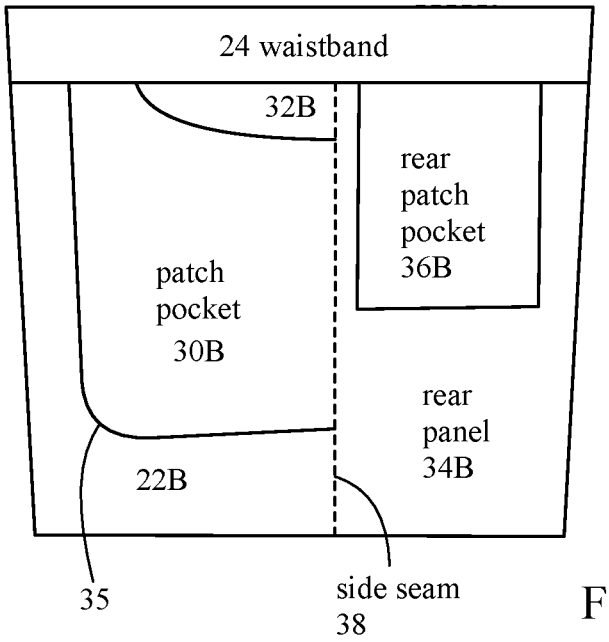
FIGS. 3A and 3B show side views of a shorts garment according to the present invention, illustrating possible placements of a rear patch pocket.
Figure 3B:
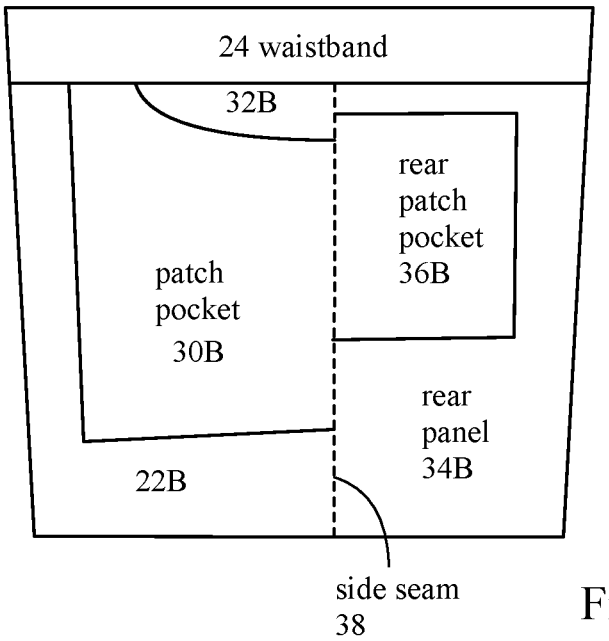

FIGS. 3A and 3B show side views of embodiments of the present invention having a rear patch pocket 36B attached to a rear panel 34B. The front panel 22B and rear panel 34B are attached at a side seam 38. One edge of the front patch pocket 30B is optionally sewn into the side seam 38. The rear patch pocket 36B can be made of the same low air permeability fabric used for the front patch pockets 30A 30B. The rear panel 34B can be made of the same fleece fabric as the front panels 22A 22B.

The rear patch pocket 36B contributes to the wind protection, thermal insulation, and durability of the present shorts garment. The rear patch pockets, like the front patch pockets, increase the warmth in the thigh areas.

In the embodiment of FIG. 3A, the rear patch pocket 36B is attached to the waistband 24, but is not attached to the side seam 38.

In the embodiment of FIG. 3B, the rear patch pocket 36B is not attached to the waistband 24, but is attached to the side seam 38.

The present invention and claims are not limited to any particular shape of the patch pockets 30A 30B. In FIG. 1, the patch pockets are rectangular. However, the patch pockets 30A 30B can also have round shapes, polygonal shapes, rounded corners. chamfered corners or any other shape suitable for human hands or holding objects. A rounded pocket corner 35 is shown in FIG. 3A.

Figure 4:
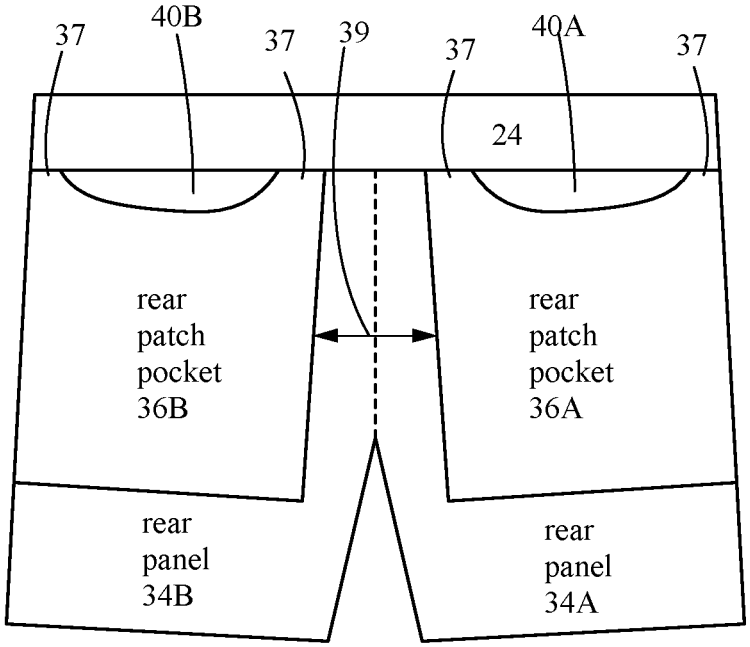
FIG. 4 shows an alternative embodiment in which the rear patch pockets have two upper corners attached to the waistband.
Figure 5:
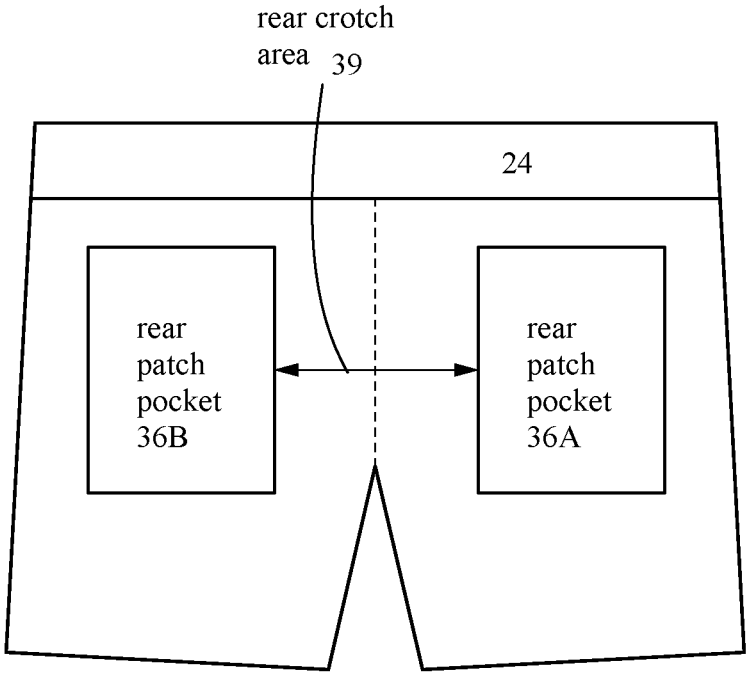
FIG. 5 shows an alternative embodiment in which the rear patch pockets are unattached to the waistband or side seams.

FIGS. 4 and 5 show other embodiments illustrating different design options for the rear patch pockets 36A 36B.

FIG. 4 shows an alternative embodiment of the present invention in which the rear patch pockets 36A 36B have two top corners 37 attached to the waistband 24. The rear patch pockets optionally may be attached to the side seam (not shown). Openings 40A 40B provide hand access to the rear pockets. In this design, the rear pockets 36A 36B will not apply tensile stress to the rear panels 34A 34B.

FIG. 5 shows an alternative embodiment of the present invention in which the rear patch pockets 36A 36B are spaced apart from the waistband 24 and side seams 38. In this design, the rear pockets 36A 36B will apply some tensile stress to the rear fleece panels, which may reduce the lifetime of the rear panels.

A rear crotch area 39 exists between the rear patch pockets 36A 36B in the embodiments of FIGS. 4 and 5. The rear crotch area 39 will have the same characteristics as the front crotch area 34. Specifically, at least a portion of the rear crotch area 39 will comprise fleece with relatively high air permeability of greater than 40, 50 or 60 CFM/SF. In some embodiments, the entire rear crotch area will comprise fleece fabric with air permeability greater than 60 CFM/SF. The width of the rear crotch (i.e. spacing between rear pockets) area may typically be about 2-14 inches, for example.

It is noted that the rear patch pockets 36A 36B are optional in the invention. The shorts according to the present invention can have zero, 1 or 2 rear patch pockets. The rear patch pockets 36A 36B will tend to increase the wind protection, thermal insulation, and durability of the present shorts garment.

The rear patch pockets 36A 36B can cover about 20%, 30%, 40% or more of the respective rear panels 34A 34B. In some embodiments, coverage by the rear patch pockets 36A 36B will be less than coverage by the front patch pockets 30A 30B. In some embodiments, this may be because the front patch pockets 30A 30B are larger, and the front panels and rear panels are roughly the same size.

It is noted that the coverage of the rear panels is typically not more than 75%, 80% or 90% of the rear fleece panels, however, as it is desirable to have some air ventilation in the rear crotch area 39.

Figure 6:
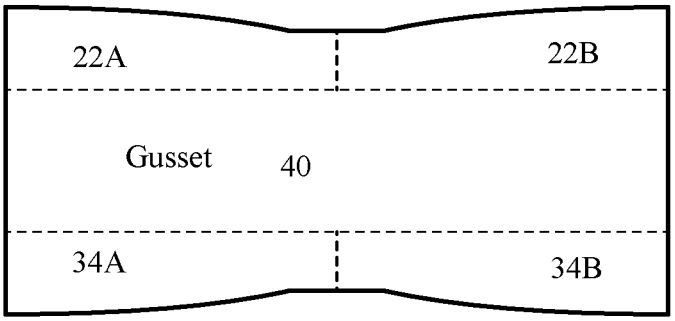
FIG. 6 shows a bottom view of an alternative embodiment having a gusset attached between the front panels and rear panels.

FIG. 6 shows a bottom view (with legs spread apart) of an embodiment of the present invention having a gusset panel 40 attached between the front panels 22A 22B and the rear panels 34A 34B. The gusset panel 40 can also be made of the same fleece fabric used for the panels 22A 22B 34A 34B. Alternatively, the gusset 40 can be made of a fabric having a higher air permeability than the fabric comprising the front and rear panels.

Figure 7:
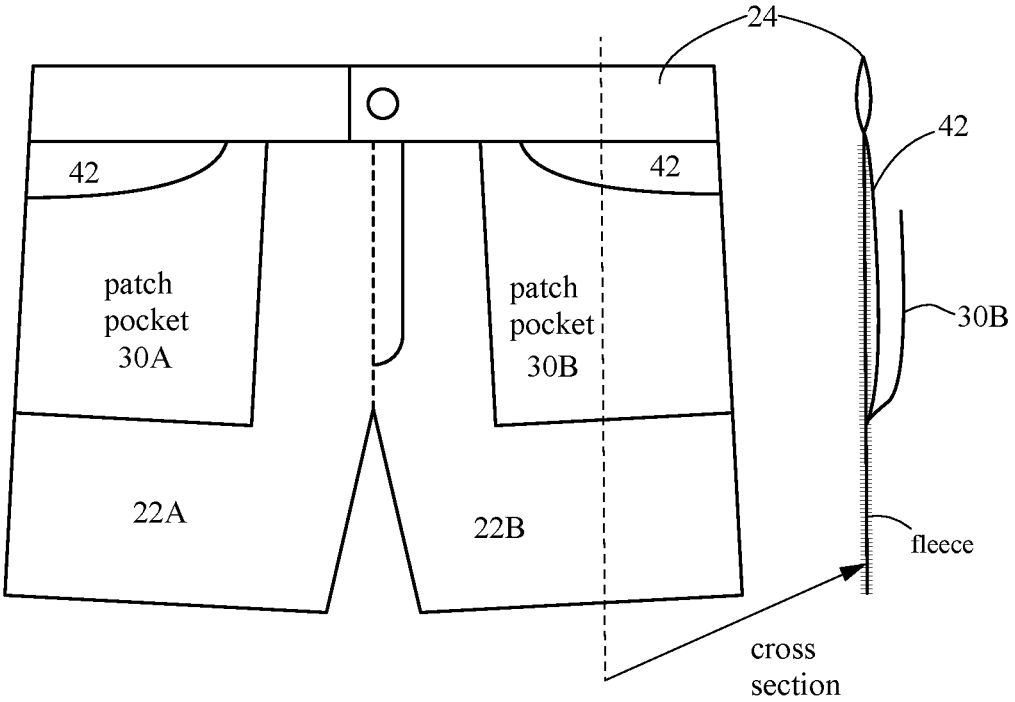
FIG. 7 shows an embodiment in which a covering fabric is disposed over the fleece inside the patch pockets.

FIG. 7 shows an embodiment of the present invention in which the openings (32A 32B in FIG. 1) above the front patch pockets 30A 30B are covered with a covering fabric 42. The covering fabric 42 may extend to a bottom of the patch pockets 30A 30B, as illustrated in the cross sectional view. The covering fabric can comprise a low air permeability fabric such as the fabric used for the patch pockets 30A 30B. The covering fabric 42 may have an air permeability less than the fleece comprising the front panels. The covering fabric will affect the coverage area calculations explained in reference to FIGS. 2A and 2B. Specifically, the portion of the opening (32A 32B in FIG. 1) covered by the covering fabric 42 will add to the area considered to be covered by the patch pockets 30A 30B. Hence, the covering fabric will tend to increase the covered percentage of the front panels.

Figure 8:
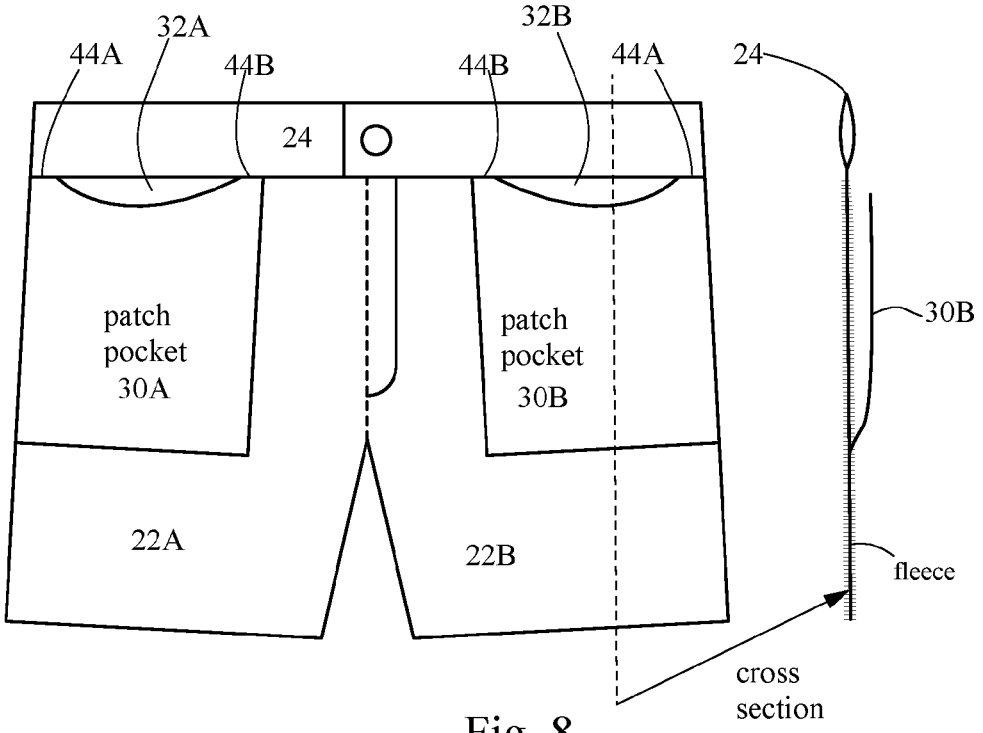
FIG. 8 shows an embodiment in which two top corners of the front patch pockets are attached to the waistband.

FIG. 8 shows an embodiment of the present invention in which the front patch pockets 30A 30B each have two connections 44A 44B to the waistband. The fleece comprising the front panels 22A 22B can be exposed in the openings 32A 32B.

Figure 9:
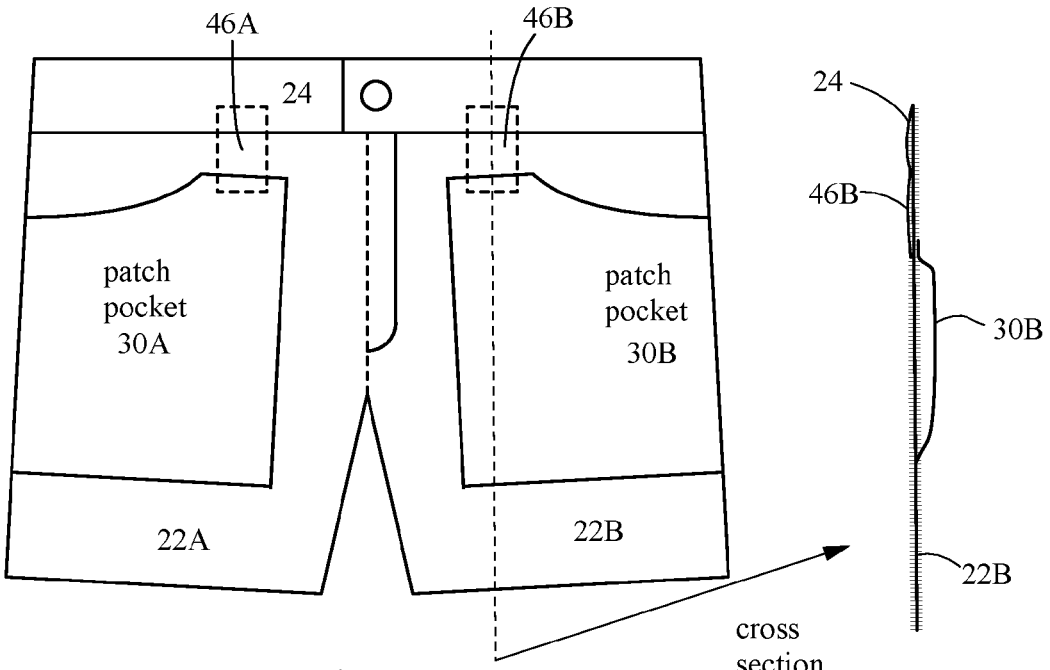
FIG. 9 shows an embodiment in which the patch pockets are not directly attached to the waistband. Reinforcement strips are used to attach the patch pockets to the waistband so that the fleece does not experience tensile stress of supporting the patch pockets.

FIG. 9 shows an alternative embodiment in which the front patch pockets 30A 30B are not directly attached to the waistband 24. Instead, the patch pockets 30A 30B are connected to the waistband via a reinforcement strip 46A 46B. The reinforcement strip is disposed behind the panels 22A 22B, and so is illustrated with a dotted line outline. The reinforcement strips 46A 46B are sewn to the patch pockets 30A 30B and to the waistband 24. The strips 46A 46*b* prevent tensile stress from being applied directly to the fleece comprising the panels 22A 22B. Tensile stress can damage the fleece by tearing, wear, or excessive stretching.

Also illustrated in FIG. 9 is the optional feature of fleece covering the waistband 24. The waistband 24 also comprises a durable fabric layer behind the fleece. For example, the waistband 24 can comprise the same fabric used for the patch pockets 30A 30B.

It is noted that the waistband 24 can comprise elastic, as known in the art.

Figure 10:
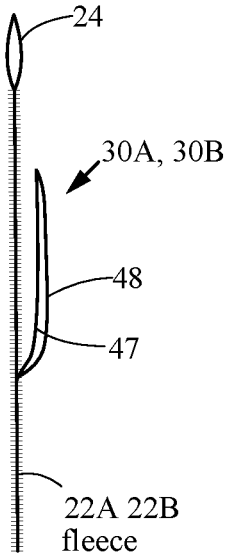
FIG. 10 shows a cross section of an embodiment in which the patch pockets comprise two layers of fabric.

FIG. 10 shows a cross sectional view of an embodiment in which the patch pockets 30A 30B comprise an inner layer 47 and an outer layer 48. One of the two layers 47 48 comprises a non-stretch, low-permeability fabric described above for the patch pockets 30A 30B (e.g. woven polyester "sueded" fabric). The other layer can comprise a softer, more insulating fabric such as fleece. For example, the outer layer 48 can comprise low permeability, non-stretch fabric, and the inner layer 47 can comprise high-permeability fleece, or vice versa. If multiple fabric layers are used for the patch pockets, then the air permeability of the patch pocket is the combined air permeability of all the layers (which is necessarily lower than any individual fabric layer).

Figure 11:
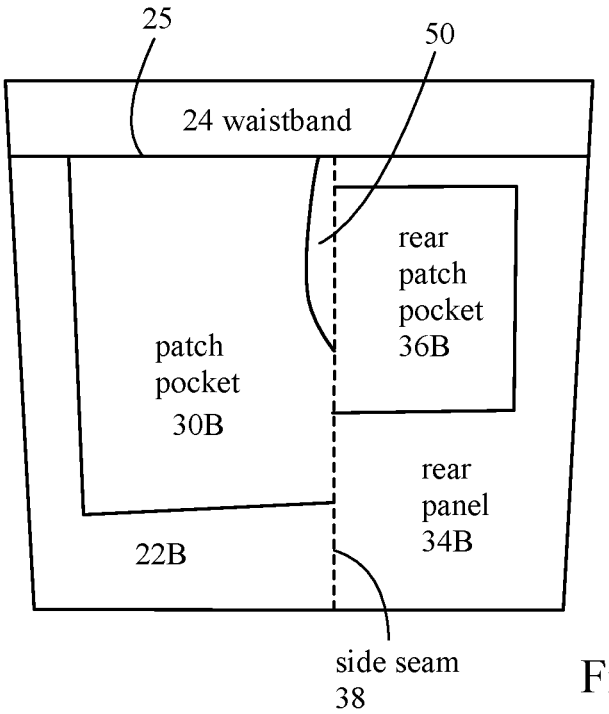
FIG. 11 shows a side view of an embodiment in which the front pockets are open along a side edge.

FIG. 11 shows a side view of an embodiment in which the patch pocket 30B has a pocket opening 50 along a side edge of the pocket 30B. The top edge 25 of the patch pocket 30B is attached to the waistband 24. The pocket opening 50 is optionally in-line with the side seam 38, as shown.

The above embodiments may be altered in many ways without departing from the scope of the invention. Accordingly, the scope of the invention should be determined by the following claims and their legal equivalents.

What is claimed is:

1. A shorts garment, comprising:

1) a right tube and a left tube comprising fleece fabric for receiving a human waist and legs, wherein the right tube and the left tube are joined at a joined end, and wherein the right tube has a right front panel, and wherein the left tube has a left front panel, and wherein an air permeability of the right front panel and the left front panel is at least 40 CFM/SF by ASTM D737;

2) a waistband circumscribing the joined end;

3) a right patch pocket attached to an exterior of the right front panel, and a left patch pocket attached to an exterior of the left front panel, wherein:

a) the right patch pocket and the left patch pocket comprise a non-fleece fabric, and b) the right patch pocket and left patch pocket have an air permeability of 30 CFM/SF or less by ASTM D737.

2. The shorts garment of claim 1 further comprising:

a) a right rear panel made of fleece and part of the right tube, and b) a left rear panel made of fleece and part of the left tube, and c) a right rear patch pocket attached to an exterior of the right rear panel, and d) a left rear patch pocket attached to an exterior of the left rear panel, wherein an air permeability of the right rear panel and the left rear panel is at least 40 CFM/SF by ASTM D737, and wherein an air permeability of the right rear patch pocket and left rear patch pocket is 30 CFM/SF or less by ASTM D737.

3. The shorts garment of claim 1 wherein the right patch pocket and left patch pocket have an air permeability of 20 CFM/SF or less by ASTM D737, and the right front panel and left front panel have an air permeability in the range of 50-350 CFM/SF by ASTM D737.

4. The shorts garment of claim 1 wherein the right patch pocket and left patch pocket have an air permeability of 10 CFM/SF or less by ASTM D737, and the right front panel and left front panel have an air permeability in the range of 50-250 CFM/SF by ASTM D737.

5. The shorts garment of claim 1 wherein the right patch pocket and waistband are attached in at least one location, and wherein the left patch pocket and waistband are attached in at least one location.

6. The shorts garment of claim 1 wherein the right patch pocket and left patch pocket is less than ¼ of the right front panel and left front panel.

7. The shorts garment of claim 1 wherein the right patch pocket and left patch pocket is less than 1/10 of the right front panel and left front panel.

8. The shorts garment of claim 1 wherein the right patch pocket covers 30-80% of the right front panel, and the left patch pocket covers 30-80% of the left front panel.

9. The shorts garment of claim 1, wherein a crotch area exists between the right patch pocket and the left patch pocket, and at least 40% of the crotch area has an air permeability of at least 50 CFM/SF by ASTM D737.

10. The shorts garment of claim 1 wherein the right patch pocket and the left patch pocket comprise a non-stretch fabric.

11. A shorts garment, comprising:

1) a right tube and a left tube comprising fleece fabric for receiving a human waist and legs, wherein the right tube and left tube are joined at a joined end and wherein the right tube has a right front panel and the left tube has a left front panel, and wherein the right front panel and left front panel have an air permeability in the range of 40-350 CFM/SF by ASTM D737;

2) a waistband circumscribing the joined end;

3) a right patch pocket attached to an exterior of the right front panel, and a left patch pocket attached to an exterior of the left front panel, wherein:

a) the right patch pocket and the left patch pocket both comprise a non-stretch, non-fleece fabric, and b) the right patch pocket and left patch pocket have an air permeability less than ¼ of the right front panel and left front panel.

12. The shorts garment of claim 11, wherein the right tube comprises a right rear panel, and the left tube comprises a left rear panel, and the right rear panel and left rear panel have an air permeability in the range of 40-350 CFM/SF by ASTM D737.

13. The shorts garment of claim 11, wherein a crotch area exists between the right patch pocket and left patch pocket, and at least 40% of the crotch area has an air permeability of at least 50 CFM/SF by ASTM D737.

14. The shorts garment of claim 11 wherein the right patch pocket and left patch pocket have an air permeability of 10 CFM/SF or less by ASTM D737, and wherein the right front panel and left front panel have an air permeability in the range of 70-350 CFM/SF by ASTM D737.

15. The shorts garment of claim 11 wherein the right patch pocket covers 30-80% of the right front panel, and the left patch pocket covers 30-80% of the left front panel.

16. A shorts garment, comprising:

1) a right tube and a left tube comprising fleece fabric for receiving a human waist and legs, wherein the right tube and the left tube are joined at a joined end, and wherein the fleece fabric has an air permeability in the range of 50-250 CFM/SF by ASTM D737 and has pile with a height of at least 1 mm on each side;

2) a waistband circumscribing the joined end;

3) a right patch pocket attached to an exterior of the right tube, and a left patch pocket attached to an exterior of the left tube, wherein:

a) the right patch pocket and the left patch pocket comprise a non-stretch, non-fleece fabric, and b) the right patch pocket and left patch pocket have an air permeability of 20 CFM/SF or less by ASTM D737.

17. The shorts garment of claim 16, wherein the air permeability of the right patch pocket and the left patch pocket is less than 1/10 of the air permeability of the right tube and the left tube.

18. The shorts garment of claim 16 wherein the right patch pocket and left patch pocket have an air permeability of 10 CFM/SF or less.

19. The shorts garment of claim 16 wherein the right patch pocket and waistband are attached in at least one location, and wherein the left patch pocket and waistband are attached in at least one location.

20. The shorts garment of claim 1 wherein the fabric comprising the patch pockets has less than 10% elongation when subjected to tensile stress of 10 pounds per 1 inch width.

21. The shorts garment of claim 11 wherein the fabric comprising the patch pockets has less than 10% elongation when subjected to tensile stress of 10 pounds per 1 inch width.

22. The shorts garment of claim 16 wherein the fabric comprising the patch pockets has less than 10% elongation when subjected to tensile stress of 10 pounds per 1 inch width.

23. The shorts garment of claim 1 wherein the right patch pocket covers 20-80% of the right front panel, and the left patch pocket covers 20-80% of the left front panel.

24. The shorts garment of claim 11 wherein the right patch pocket covers 30-80% of the right front panel and the left patch pocket covers 30-80% of the left front panel.

25. The shorts garment of claim 16 wherein the right tube comprises a right front panel, and the left tube comprises a left from panel, and wherein the right patch pocket covers 30-80% of the right front panel and the left patch pocket covers 30-80% of the left front panel.

* * * * *